US006114293A

United States Patent [19]

Beaver et al.

[11] Patent Number: 6,114,293

[45] Date of Patent: Sep. 5, 2000

[54] MOVIE FILM CLEANING PROCESS USING HALOGENATED HYDROBROMOCARBON SOLVENTS

[75] Inventors: Phillip R. Beaver; James E. Boone; Dixie E. Goins; Eric W. Liimatta; David L. Shelton; Ronald L. Shubkin, all of Baton Rouge, La.

[73] Assignee: Albemarle Corporation, Richmond, Va.

[21] Appl. No.: 09/229,780

[22] Filed: Jan. 13, 1999

[51] Int. Cl.[7] ..... B08B 3/08; C11D 7/30; C11D 7/50

[52] U.S. Cl. ..... 510/169; 134/40; 134/42; 510/412

[58] Field of Search ..... 510/169, 412; 134/40, 42

[56] References Cited

U.S. PATENT DOCUMENTS

| | | | |
|---|---|---|---|
| 3,773,677 | 11/1973 | Boyles | 252/172 |
| 4,056,403 | 11/1977 | Cramer et al. | 134/22 R |
| 4,193,838 | 3/1980 | Kelly et al. | 162/5 |
| 5,207,953 | 5/1993 | Thorssen et al. | 252/601 |
| 5,665,173 | 9/1997 | Lee | 134/40 |
| 5,669,985 | 9/1997 | Lee et al. | 134/40 |
| 5,679,632 | 10/1997 | Lee et al. | 510/412 |

*Primary Examiner*—Christine Skane
*Attorney, Agent, or Firm*—E. E. Spielman, Jr.

[57] ABSTRACT

A process for cleaning movie film, and especially cellulose acetate based polymer film, without causing film damage, comprises immersing the film into a cleaning solvent composition which comprises one or more halogenated hydrobromocarbons having from 1 to 3 carbons, from 1 to 3 bromine atoms and at least one chlorine or fluorine atom, such as 3-bromo-1,1,1-trifluoropropane, removing the film from the solvent and drying the film.

7 Claims, No Drawings

MOVIE FILM CLEANING PROCESS USING HALOGENATED HYDROBROMOCARBON SOLVENTS

TECHNICAL FIELD

This invention relates to an environmentally friendly solvent cleaning process for cleaning movie film, in particular, cellulose triacetate film.

BACKGROUND OF THE INVENTION

Movie film is designed for repetitive use and, as such, must be durable and true to its original shape and size over a long period of time. Curling, cracking or peeling of the film is not tolerable. In addition, the film must be kept clean from skin oils, dust and other matter which can be deposited during film processing and handling. It is generally necessary to clean movie film several times during its life. Cleaning is conveniently done by immersing the film in a solvent which may be contemporaneously subjected to sonication. The solvent is contained in a tank and the film is fed through the tank via film guides. The film is dried as it is removed from the tank and is rewound. The solvent must be capable of cleaning the film without leaving a deposit on the film and without causing any distortion or damage to the film.

Heretofore, a preferred solvent has been 1,1,1-trichloroethane. However, this solvent is no longer favored due to environmental concerns. Alkyl bromide solvents, and especially n-propyl bromide, are environmentally acceptable but may cause film damage and so must be used in combination with co-solvents (see U.S. Pat. Nos. 5,665,173, 5,669,985, and 5,679,632).

The addition of small amounts of no more than about 5% by volume of a fluorine and/or chlorine containing brominated hydrocarbon, such as dibromodifluoromethane, to a flammable organic solvent to provide a fire retardant solvent composition is disclosed in U.S. Pat. No. 5,207,953. A hot vapor stripping process for removing resin coatings from paperstock, which uses an acyclic hydrocarbon containing one to three carbons and two to eight bromine, chlorine or fluorine atoms, at least two of which are bromine or chlorine, is described in U.S. Pat. No. 4,193,838. Solvents such as bromochloromethanes have been disclosed for use in various equipment cleaning operations (for example see U.S. Pat. Nos. 3,773,677 and 4,056,403).

A film cleaning process has now been found which uses environmentally friendly alkyl brominated solvents which do not require the presence of co-solvents in order to avoid film damage. The solvents include at least one other halogen atom chosen from chlorine and fluorine.

SUMMARY OF THE INVENTION

In accordance with this invention there is provided a process for cleaning movie film, which process comprises immersing the film into a cleaning solvent composition which comprises one or more halogenated hydrobromocarbons having from 1 to 3 carbons, from 1 to 3 bromine atoms and at least one chlorine or fluorine atom, removing the film from the solvent and drying the film.

DETAILED DESCRIPTION

Suitable halogenated hydrobromocarbon compounds for use as cleaning solvents in accordance with the invention have from 1 to 3 carbon atoms, from 1 to 3 bromine atoms and from 1 to 6 fluorine atoms and/or 1 to 3 chlorine atoms.

The halogen atoms can be attached at any position on the carbon chain. The compounds should be liquid at room temperature, preferably with a boiling range of from about 50 to 120° C., have no flash point, no major environmental or toxicology problems (e.g., mutagen, ozone depleter, carcinogen, etc.). They should also have hydrolytic and thermal stability and moderate to low odor. Non-limiting specific examples of suitable compounds include 3-bromo-1,1,1-trifluoropropane, 1,3-dibromo-1,1-difluoropropane, dibromofluoromethane, 1-bromo-3-fluoropropane, chlorodibromofluoromethane, fluorotribromomethane, 1,2-dibromohexafluoropropane, 1,2-dibromo- 1,1-difluoroethane, 2-bromo-2-chloro-1,1,1-trifluoroethane, chlorodibromomethane, 1-bromo-2-chloroethane, 2-bromo-1-chloropropane and bromotrichloromethane. Mixtures of two or more of the above solvents can be used.

Co-solvents are not necessary but can be used in amounts of up to about 60 weight percent of the solvent portion of the cleaning solvent composition, provided that the cleaning solvent mixture remains non-flammable and does not cause damage to the film. Non-limiting examples of suitable co-solvents include alkyl bromides having 4 to 7 carbon atoms, such as n-butyl bromide or n-heptyl bromide and alkanes having 6 or 7 carbon atoms, such as n-hexane or n-heptane.

It may be desirable to include from about 0.05 to 15 weight percent, based on the total weight of cleaning solvent composition, of one or more stabilizer compounds, such as metal passivators and acid acceptors, for the cleaning solvent in order to minimize the corrosive effects of any hydrolysis products which may form due to the dehydrohalogenation of the solvent during the cleaning process.

For example, when the solvents contact certain metals, such as aluminum, magnesium and titanium, the metals appear to catalyze the dehydrohalogenation of the solvent to produce halogen acid which is corrosive to metals. Non-limiting examples of suitable types of compounds for stabilizing the solvents include ethers, nitroalkanes, epoxides, alcohols and amines.

Non-limiting examples of suitable ethers include 1,2-dimethoxyethane, 1,4-dioxane, 1,3-dioxolane, diethyl ether, diisopropyl ether, dibutyl ether, trioxane, alkyl cellosolves in which the alkyl group has 1 to 10 carbon atoms such as methyl cellosolve, ethyl cellosolve and isopropyl cellosolve, dimethyl acetal, γ-butyrolactone, methyl t-butyl ether, tetrahydrofuran and N-methylpyrrole. They are usable either singularly or in the form of a mixture of two or more of them.

Non-limiting examples of suitable epoxides and alcohols include the epoxides epichloro-hydrin, propylene oxide, butylene oxide, cyclohexene oxide, glycidyl methyl ether, glycidyl methacrylate, pentene oxide, cyclopentene oxide and cyclohexene oxide and the alcohols isopropanol, propanol, butanol and sec-butanol. They are usable either singularly or in the form of a mixture of two or more of them.

Non-limiting examples of nitroalkanes usable in the present invention include nitromethane, nitroethane, 1-nitropropane, 2-nitropropane and nitrobenzene. They are usable either singularly or in the form of a mixture of two or more of them.

Non-limiting examples of suitable amines include hexylamine, octylamine, 2-ethylhexylamine, dodecylamine, ethylbutylamine, hexylmethylamine, butyloctylamine, dibutylamine, octadecylmethylamine, triethylamine, tributylamine, diethyloctylamine, tetradecyldimethylamine, diisobutylamine, diisopropylamine, pentylamine, N-methylmorpholine, isopropylamine, cyclohexylamine, butylamine, isobutylamine, dipropylamine, 2,2,2,6-tetramethylpiperidine, N,N-diallyl-p-phenylenediamine, diallylamine, aniline, ethylenediamine, propylenediamine, diethylenetriamine, tetraethylenepentamine, benzylamine, dibenzylamine, diphenylamine and diethylhydroxyamine. They are usable either singularly or in the form of a mixture of two or more of them.

When present, preferred amounts of each type of stabilizer compound include from about 0.05 to about 1.0 wt. % epoxide, from about 0.05 to about 1.0 wt. % alcohol, from about 0.5 to about 4.0 wt. % ether, from about 0.05 to about 1.0 wt. % nitroalkane and from about 0.05 to about 1.0 wt. % amine, with each of the above percentages being based on the total weight of solvent cleaning composition.

In cleaning movie film, the solvent is usually kept at a bath temperature within the range of from about 20 to about 45° C. The residency time for the film in the bath is conventionally about 0.1 to 5 seconds. The film drying temperature is about 25 to 35° C. The cellulose triacetate polymer based movie films discussed herein are available from Eastman Kodak Company. These movie films are used in movie cameras.

The invention is further illustrated by, but is not intended to be limited to, the following examples. The halogenated hydrobromocarbons used in the examples are all known compounds and are available, for example, from Aldrich Chemicals.

EXAMPLE 1

Individually, eight samples of cellulose triacetate polymer based color negative movie film from Eastman Kodak Company are each immersed in a bath containing one of the fluorinated and/or chlorinated hydrobromocarbon solvents listed below for 10 minutes at room temperature. The samples are then removed and allowed to dry for 1 hour. The film samples are then compared to the following controls: 1,1,1-trichloroethane (no damage to film), n-propyl bromide (moderate curling damage to film) and acetone (heavy damage to film). In the case of all of the eight test solvents listed below, no damage to the film is observed.

Cleaning Solvent:

3-bromo-1,1,1-trifluoropropane (b.p.=63.5° C.)[CAS# 460-32-2]

1,3-dibromo-1,1-difluoropropane (b.p.=62° C.)[CAS# 460-25-3]

dibromofluoromethane (b.p. 65° C.)[CAS# 1868-53-7]

1-bromo-3-fluoropropane [CAS# 352-91-0]

chlorodibromofluoromethane [CAS# 353-55-9].

chlorodibromomethane [CAS# 124-48-1]

1-bromo-2-chloroethane [CAS# 107-04-0]

2-bromo-1-chloropropane [CAS# 3017-95-6].

The results in Example 1 demonstrate the successful use of the process of the invention where skin oils, dust and other matter, which can be deposited on movie film during processing and handling, are removed from the film surface without damage to the film. In contrast, the use of the non-fluorinated or chlorinated alkyl bromide counterpart compound, n-propyl bromide, causes film curling damage.

What is claimed is:

1. A process for cleaning movie film, which process comprises immersing the film into a cleaning solvent composition which comprises one or more halogenated hydrobromocarbons having from 1 to 3 carbons, from 1 to 3 bromine atoms and at least one chlorine or fluorine atom, removing the film from the solvent and drying said film.

2. The process according to claim 1 wherein said halogenated hydrobromocarbon is selected from the group consisting of 3-bromo-1,1,1-trifluoropropane, 1,3-dibromo-1,1-difluoropropane, dibromofluoromethane, 1-bromo-3-fluoropropane, chlorodibromofluoromethane, fluorotribromomethane, 1,2-dibromohexafluoropropane, 1,2-dibromo-1,1-difluoroethane, 2-bromo-2-chloro-1,1,1-trifluoroethane, chlorodibromomethane, 1-bromo-2-chloroethane, 2-bromo-1-chloropropane and bromotrichloromethane, including mixtures thereof.

3. The process according to claim 1 wherein said halogenated hydrobromocarbon includes from 1 to 6 fluorine atoms.

4. The process according to claim 1 wherein said halogenated hydrobromocarbon includes from 1 to 3 chlorine atoms.

5. The process according to claim 1 wherein said film is cellulose triacetate polymer film.

6. The process according to claim 1 wherein said cleaning solvent composition includes a co-solvent.

7. The process according to claim 1 wherein said cleaning solvent composition includes one or more stabilizer compounds for the cleaning solvent portion of said composition.

* * * * *